US006390667B2

(12) United States Patent
Simonis

(10) Patent No.: US 6,390,667 B2
(45) Date of Patent: May 21, 2002

(54) WRISTWATCH AND WRISTLET ABLE TO BE FITTED TO SUCH A WATCH

(75) Inventor: Jerry G. Simonis, Le Locle (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/809,271

(22) Filed: Mar. 16, 2001

(30) Foreign Application Priority Data

Mar. 17, 2000 (EP) ..... 00200983

(51) Int. Cl.[7] ..... G04B 37/00
(52) U.S. Cl. ..... 368/282
(58) Field of Search ..... 368/281, 282; 224/170–180, 169

(56) References Cited

U.S. PATENT DOCUMENTS 2,998,695 A * 9/1961 Cornett ..... 150/154
3,610,488 A * 10/1971 Tracy ..... 368/282
4,964,092 A * 10/1990 Brida ..... 224/170

FOREIGN PATENT DOCUMENTS

| | | |
|---|---|---|
| DE | 297 16 248 | 10/1997 |
| EP | 869413 | 10/1998 |
| FR | 1 182 148 | 6/1959 |

* cited by examiner

*Primary Examiner*—Bernard Roskoski
(74) *Attorney, Agent, or Firm*—Sughrue Mion, PLLC

(57) ABSTRACT

The invention concerns a watch formed of a wristlet (12) and a case (10) provided with a slide-way (30) in which the wristlet (12) is engaged and may be moved in translation, wherein the wristlet is formed of a strap (36) the length of which substantially corresponds to the length of the wristlet and wherein the two longitudinal edges (36*a*, 36*b*) of said strap are rolled over their entire length to form two rolls (36*d*, 36*e*).

10 Claims, 2 Drawing Sheets

WRISTWATCH AND WRISTLET ABLE TO BE FITTED TO SUCH A WATCH

The present invention relates to wristwatches. It concerns, more particularly, watches formed of a case provided with a slide-way and a wristlet engaged in the slide-way and able to move in translation. Watches of this type are known, for example, from European Patent No. 0 264 874, GB Patent No. 2 217 577, U.S. Pat. No. 5,068,840 or Belgian Patent No. 545 237. Such a solution allows a wristlet with a single strand to be made. Moreover, the case may be moved on the wristlet, so as to place it in a position chosen by the person wearing the watch, in particular to facilitate reading the time.

In these watches, the wristlet or watch strap is made of a flexible material, generally leather or fabric. This may result in rapid wear, due to the friction of the slide-way on the wristlet. However, if the case can move too easily along the wristlet, it is liable to move when worn, frequently obliging the person wearing it to put it back in place.

The main object of the invention is to overcome these drawbacks. This object is achieved by the watch defined by claim 1.

Particularly good results have been obtained using a strap made of a knitted thread, in particular a metal thread, for example defining a so-called Milanese structure.

Tests have shown that the two rolls forming the wristlet can be obtained by permanently deforming the strap formed by bending, the longitudinal edges of the latter being in contact with its median portion. It is thus not necessary to weld or bond the edges of the strap to guarantee the shape of the wristlet. Moreover, the structure thereby obtained has great flexibility and rounded edges, making it more comfortable for the person wearing it.

In the watch according to the invention, it is desirable for the wristlet to be easily moved in the slide-way when it is in an extended position, so as to be able to position it quickly. When the watch is being worn, however, it is preferable for the case to be able to slide only insofar as the person wearing it wishes. This is why, in an advantageous manner, the wristlet and the case are arranged so that, in the extended position, the wristlet can slide freely on the case, while in the bent position, the case can only be moved on the wristlet via the action of force which is higher the lower the radius of curvature of the wristlet.

This feature may be obtained when the rolls define a resilient structure which forms rough portions intended to co-operate with the walls of the slide-way when the wristlet is bent. Thus, the rough portions, by co-operating with the walls of the slide-way, assure proper positioning of the case, without thereby blocking it.

In known watches, the slide-way is formed of loops which define a rectangular opening delimited by walls on four sides. With such a structure, applied to a watch in which friction is defined by the rough portions of the wristlet on the walls of the slide-way, the latter is liable to prevent any movement of the watch when it is being worn. This is why, in an advantageous manner, the case is of generally parallelepiped shape, including in particular two large faces and two small faces, in which:

- one of the large faces, the top one, is provided with a crystal through which the time can be read;
- the other large face, the bottom one, forms one of the walls of the slide-way, and
- the two small faces extend beyond the large bottom face and form claws which constitute, with the bottom face, the walls of the slide-way.

In order to assure comfortable wear, aesthetic appearance and longevity, both the wristlet and the case are made of metal.

The invention also concerns a wristlet, in particular a watch wristlet, according to claim 10.

Other advantages and features of the invention will appear from the following description, made with reference to the annexed drawing, in which.

Figure 1:
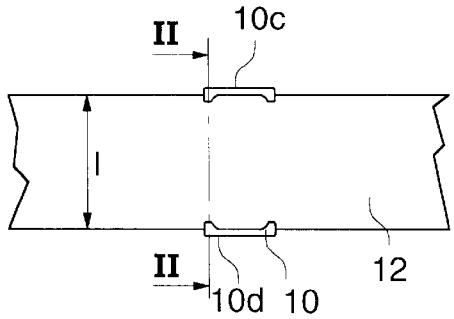
FIG. 1 shows a preferred embodiment of the watch according to the invention, seen from below.
Figure 2:
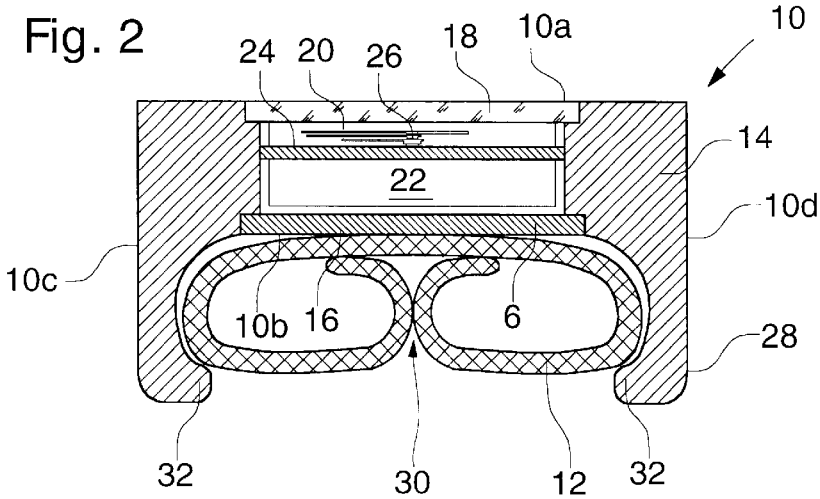
FIG. 2 is a cross-section of this watch along the line 11-11 of FIG. 1.

The watch shown in FIG. 1 includes a case 10 and a wristlet 12, of width I, mounted so as to be able to slide, as will be explained with reference to FIG. 2. The latter is a cross-section of the watch of FIG. 1, shown on a substantially larger scale.

Case 10 includes a middle part 14, a back cover 16, both made of stainless steel, and a crystal 18 made of a transparent material, which together define a housing 20 inside which is located a watch movement 22 carrying a dial 24 and hands 26.

Case 10 is generally parallelepiped shape. It includes two large faces 10*a* and 10*b*, two small faces 10*c* and 10*d* and two medium faces 10*e* and 10*f*.

Top face 10*a* is essentially formed of crystal 18 through which the time can be read. Bottom face 10*b* is defined by back cover 16.

The two small faces 10*c* and 10*d* are arranged parallel to the edges of wristlet 12. They extend beyond bottom face 10*b* and from claws 28 which constitute, with the bottom face, the walls of a slide-way 30 in which wristlet 12 is engaged. Each claw 28 is provided with a raised portion 32, the raised portions facing each other, so as to prevent wristlet 12 from coming out of slide-way 30.

Figure 3:
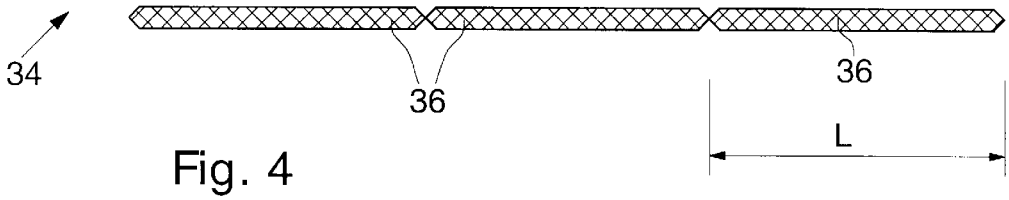
FIGS. 3 and 4 illustrate the manufacturing steps of a wristlet according to the invention.
Figure 4:
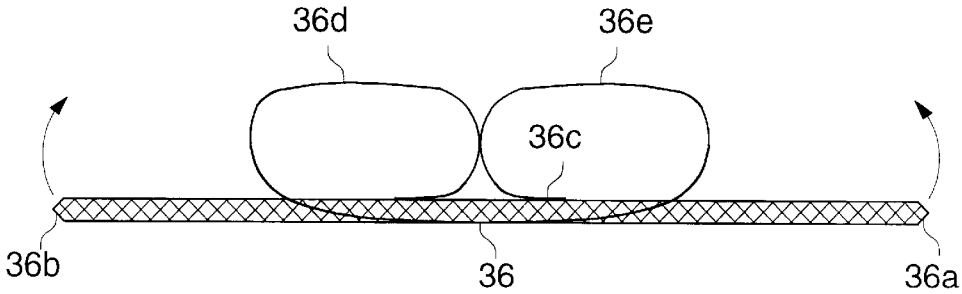

As FIG. 3 shows, wristlet 12 is formed from a woven sheet 34 manufactured from a stainless steel thread, the diameter of which is comprised between 0.1 and 0.3 mm. The structure of the woven mesh is only shown schematically, to facilitate the drawing, since it is well known to those skilled in the art. The sheet 34 is cut into straps 36.

The cutting operation causes the wire to be crushed on the edges 36*a* and 36*b*, which prevents the woven mesh from coming undone. These edges however have a relatively sharp structure, which is uncomfortable to touch. In the wristlet according to the invention, strap 36 is cut to a width L lightly greater than twice the width I of the wristlet (FIG. 2).

In order to avoid this sharp structure, the two edges 36*a* and 36*b* are rolled across their entire length and held in shape by bending, in median portion 36*c* of the strap, thus forming two hollow scrolls or rolls 36*d* and 36*e*.

Making rolls 36*d* and 36*e* causes a slight transverse deformation of median portion 36*c*, which bends slightly. The wristlet thereby made has a structure which is particularly pleasing to touch, not only because the sharp edges have been concealed, but also because all the surfaces are rounded.

After edges 36*a* and 36*b* have been welded, wristlet attachments are secured, in a conventional manner, to the ends of the strap thereby formed, to allow the wristlet to be placed and removed on the arm of a wearer.

Figure 5:
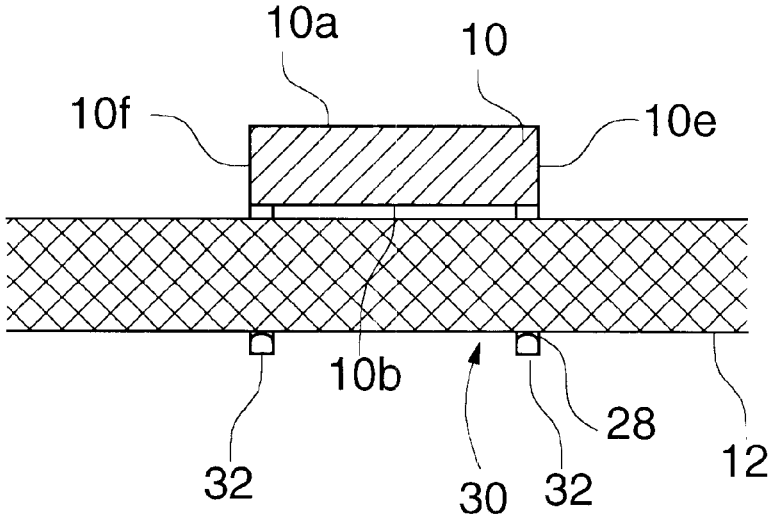
FIGS. 5 and 6 show schematically the way in which the case and the wristlet co-operate with the wristlet respectively in the open and closed position.

The dimensions of wristlet 12 are chosen so that, when it is extended, it can slide freely in slide-way 30, as can be seen in FIG. 5.

Figure 6:
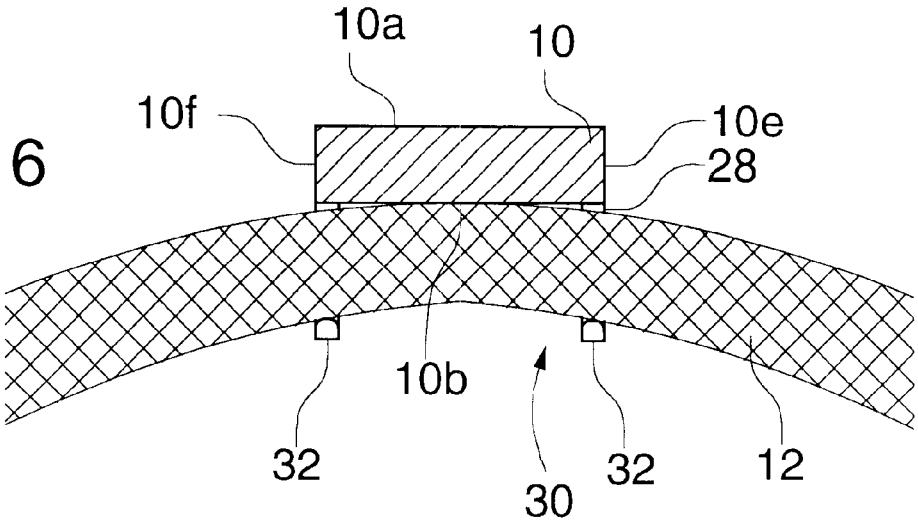

When the watch is secured to a wearer's wrist, the wristlet is bent longitudinally (FIG. 6). As a result the median portion of the wristlet comes into contact with back cover 16 of case 10 and rolls 36*d* and 36*e* with raised portions 32. The knitted structure, in which the mesh forms rough portions, generates friction of the wristlet on the case. The friction is greater the more wristlet 12 is bent.

Because of the shape of rolls 36*d* and 36*e*, the curvature of the wristlet may be more or less pronounced, without posing any problem, since each of them can easily be resiliently deformed.

The present invention may be subject to numerous variants. It is thus possible to make a watch with a round case. In such case, there is a certain rupture between the shape of the case in the portion housing the movement and that forming the slide-way. Such a solution can offer interesting aesthetic possibilities.

A watch of this type may also be made of plastic material. It is then advantageous for the face of the wristlet intended to be in contact with the arm of the person wearing it to have a rough surface, which thus forms rough portions co-operating with the claws to perform the friction function.

One may envisage making the wristlet from a knitted sheet manufactured by means of a plastic or synthetic thread of the semi-rigid type. In such case, the rolled longitudinal edges of the wristlets could be held in this position for example by welding or bonding. Of course, in such case, the watch case will preferably be made of plastic material to prevent the wristlet being worn out too quickly.

What is claimed is:

1. A watch formed of a wristlet and a case provided with a slide-way in which the wristlet is engaged and may be moved in translation, wherein the wristlet is formed of a strap the length of which substantially corresponds to the length of the wristlet and wherein the two longitudinal edges of said strap are rolled over their entire length to form two rolls.

2. A watch according to claim 1, wherein the strap is formed of a thread mesh.

3. A watch according to claim 2, wherein said thread is metal.

4. A watch according to claim 2, wherein said wristlet is formed of thread mesh forming a so-called Milanese structure.

5. A watch according to claim 1, wherein the longitudinal edges of said strap are in contact with a median portion of the strap and held in shape by bending.

6. A watch according to claim 1, wherein the wristlet and the case are arranged so that, in an extended position, the wristlet can slide freely on the case and wherein, in a bent position, the case can only slide via the action of force which is higher the smaller the radius of curvature of the wristlet.

7. A watch according to claim 1, wherein said rolls define a resilient structure which defines rough portions intended to co-operate with the walls of said slide-way when said wristlet is bent.

8. A watch according to claim 1, wherein said case is of generally parallelepiped shape, including in particular two large faces and two small faces, in which:

one of the large faces, the top one, is provided with a crystal through which the time can be read;

the other large face, the bottom one, forms one of the walls of the slide-way, and the two small faces extend beyond the large bottom face and form claws which constitute, with said bottom face, the walls of said slide-way.

9. A watch according to claim 1, wherein the wristlet and the case are made of metal.

10. A wristlet in particular, for a watch, including a strap the two longitudinal edges of which are rolled over their entire length to form two rolls.

* * * * *